US006616253B1

(12) United States Patent
Greaux

(10) Patent No.: US 6,616,253 B1
(45) Date of Patent: Sep. 9, 2003

(54) GARMENT HOLDING DEVICE

(76) Inventor: Coretta Greaux, 7951-1 S. Aragon Blvd., Sunrise, FL (US) 33322

( * ) Notice: Subject to any disclaimer, the term of this patent is extended or adjusted under 35 U.S.C. 154(b) by 0 days.

(21) Appl. No.: 09/881,881

(22) Filed: Jun. 15, 2001

(51) Int. Cl.[7] ..... A47E 5/08
(52) U.S. Cl. ..... 312/248; 312/245
(58) Field of Search ..... 312/245, 246, 312/248, 204, 138.1; 108/47, 48; 49/501; 160/355, 371, 379, 380

(56) References Cited

U.S. PATENT DOCUMENTS

| | | | | | |
|---|---|---|---|---|---|
| 658,880 | A | * | 10/1900 | Tandy | 312/248 |
| 1,035,015 | A | * | 8/1912 | Johnson | 312/248 |
| 1,450,171 | A | | 4/1923 | Cuthbert | |
| 1,480,687 | A | | 1/1924 | Loomis | |
| 1,485,714 | A | * | 3/1924 | Roach | 312/248 |
| 1,538,424 | A | | 5/1925 | Cuthbert | |
| 1,906,208 | A | * | 4/1933 | Greenberg | 312/248 |
| 1,991,951 | A | * | 2/1935 | Matchette | 312/248 |
| 2,661,258 | A | * | 12/1953 | Dinken | 312/245 |
| 2,717,819 | A | * | 9/1955 | Kirkwood, Jr. | 312/245 |
| 3,871,434 | A | * | 3/1975 | Hance | 160/104 |
| D270,665 | S | | 9/1983 | Cascone et al. | |
| 4,858,867 | A | | 8/1989 | King | |
| 4,978,001 | A | * | 12/1990 | Nelson | 206/6.1 |
| 5,022,722 | A | | 6/1991 | Wallin | |
| 5,769,145 | A | * | 6/1998 | Kwatonowski | 160/371 |
| 6,361,130 | B1 | * | 3/2002 | Kardy | 211/85.2 |

FOREIGN PATENT DOCUMENTS

| | | | | |
|---|---|---|---|---|
| CH | 675528 | * | 10/1990 | 312/245 |
| DE | 3437912 | * | 4/1986 | 312/245 |
| GB | 2187780 | * | 9/1987 | 160/374 |

* cited by examiner

*Primary Examiner*—Lanna Mai
*Assistant Examiner*—Hanh Van Tran

(57) ABSTRACT

A garment holding device for providing additional storage space on a closet door. The garment holding device includes a housing having a back wall, and a peripheral wall extending away from and attached to the back wall. The peripheral wall has an outer edge defining an opening into the housing. The back wall has a generally rectangular shape such that the peripheral wall includes a pair of lateral sides, a top side and a bottom side. A door is hingedly coupled to a first of the lateral sides of the peripheral wall and is selectively positioned between a closed position generally covering the opening in the housing and an open position. A pair of hinges is attached to the back wall and is positioned generally adjacent to the first side wall. Each of the hinges is attached to a vertical wall for hingedly coupling the housing to the vertical wall.

1 Claim, 2 Drawing Sheets

GARMENT HOLDING DEVICE

BACKGROUND OF THE INVENTION

1. Field of the Invention

The present invention relates to garment storage devices and more particularly pertains to a new garment holding device for providing additional storage space on a closet door.

2. Description of the Prior Art

The use of garment storage devices is known in the prior art. More specifically, garment storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,022,722; U.S. Pat. No. 4,858,867; U.S. Pat. No. 1,538,424; U.S. Pat. No. 1,480,687; U.S. Pat. No. 1,450,171; and U.S. Des. Pat. No. 270,665.

While these devices fulfill their respective, particular objectives and requirements, the aforementioned patents do not disclose a new garment holding device. The inventive device includes a housing having a back wall, and a peripheral wall extending away from and attached to the back wall. The peripheral wall has an outer edge defining an opening into the housing. The back wall has a generally rectangular shape such that the peripheral wall includes a pair of lateral sides, a top side and a bottom side. A door is hingedly coupled to a first of the lateral sides of the peripheral wall and is selectively positioned between a closed position generally covering the opening in the housing and an open position. A pair of hinges is attached to the back wall and is positioned generally adjacent to the first side wall. Each of the hinges is attached to a vertical wall for hingedly coupling the housing to the vertical wall.

In these respects, the garment holding device according to the present invention substantially departs from the conventional concepts and designs of the prior art, and in so doing provides an apparatus primarily developed for the purpose of providing additional storage space on a closet door.

SUMMARY OF THE INVENTION

In view of the foregoing disadvantages inherent in the known types of garment storage devices now present in the prior art, the present invention provides a new garment holding device construction wherein the same can be utilized for providing additional storage space on a closet door.

The general purpose of the present invention, which will be described subsequently in greater detail, is to provide a new garment holding device apparatus and method which has many of the advantages of the garment storage devices mentioned heretofore and many novel features that result in a new garment holding device which is not anticipated, rendered obvious, suggested, or even implied by any of the prior art garment storage devices, either alone or in any combination thereof.

To attain this, the present invention generally comprises a housing having a back wall, and a peripheral wall extending away from and attached to the back wall. The peripheral wall has an outer edge defining an opening into the housing. The back wall has a generally rectangular shape such that the peripheral wall includes a pair of lateral sides, a top side and a bottom side. A door is hingedly coupled to a first of the lateral sides of the peripheral wall and is selectively positioned between a closed position generally covering the opening in the housing and an open position. A pair of hinges is attached to the back wall and is positioned generally adjacent to the first side wall. Each of the hinges is attached to a vertical wall for hingedly coupling the housing to the vertical wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new garment holding device apparatus and method which has many of the advantages of the garment storage devices mentioned heretofore and many novel features that result in a new garment holding device which is not anticipated, rendered obvious, suggested, or even implied by any of the prior art garment storage devices, either alone or in any combination thereof.

It is another object of the present invention to provide a new garment holding device which may be easily and efficiently manufactured and marketed.

It is a further object of the present invention to provide a new garment holding device which is of a durable and reliable construction.

An even further object of the present invention is to provide a new garment holding device which is susceptible of a low cost of manufacture with regard to both materials and labor, and which accordingly is then susceptible of low prices of sale to the consuming public, thereby making such garment holding device economically available to the buying public.

Still yet another object of the present invention is to provide a new garment holding device which provides in the apparatuses and methods of the prior art some of the advantages thereof, while simultaneously overcoming some of the disadvantages normally associated therewith.

Still another object of the present invention is to provide a new garment holding device for providing additional storage space on a closet door.

Yet another object of the present invention is to provide a new garment holding device which includes a housing having a back wall, and a peripheral wall extending away from and attached to the back wall. The peripheral wall has an outer edge defining an opening into the housing. The back wall has a generally rectangular shape such that the peripheral wall includes a pair of lateral sides, a top side and a bottom side. A door is hingedly coupled to a first of the lateral sides of the peripheral wall and is selectively positioned between a closed position generally covering the opening in the housing and an open position. A pair of hinges is attached to the back wall and is positioned generally adjacent to the first side wall. Each of the hinges is attached to a vertical wall for hingedly coupling the housing to the vertical wall.

Still yet another object of the present invention is to provide a new garment holding device that allows a person with insufficient closet space to add a device onto the closet door which will provide additional garment storage area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
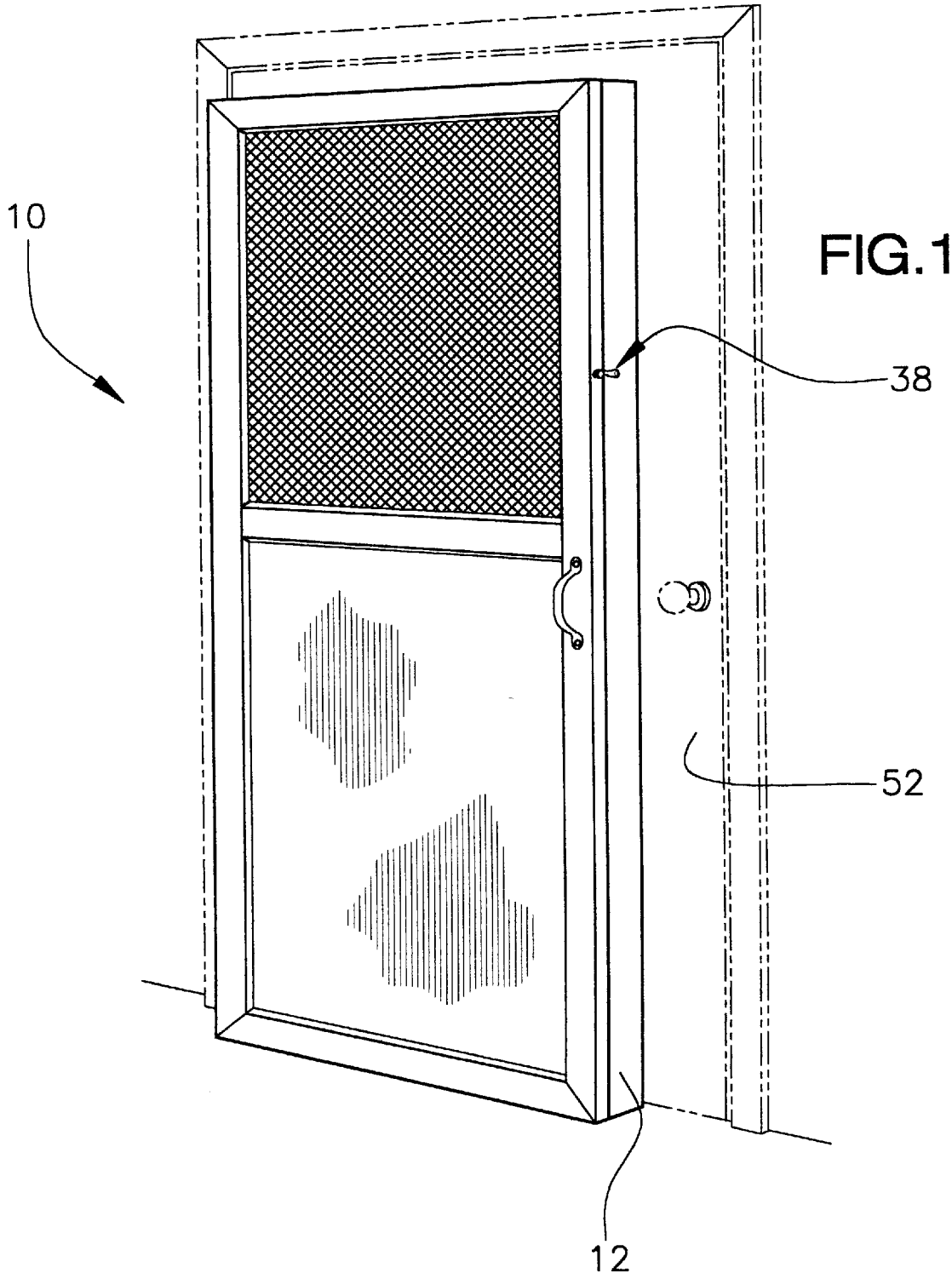
FIG. 1 is a schematic perspective view of a new garment holding device according to the present invention.
Figure 3:
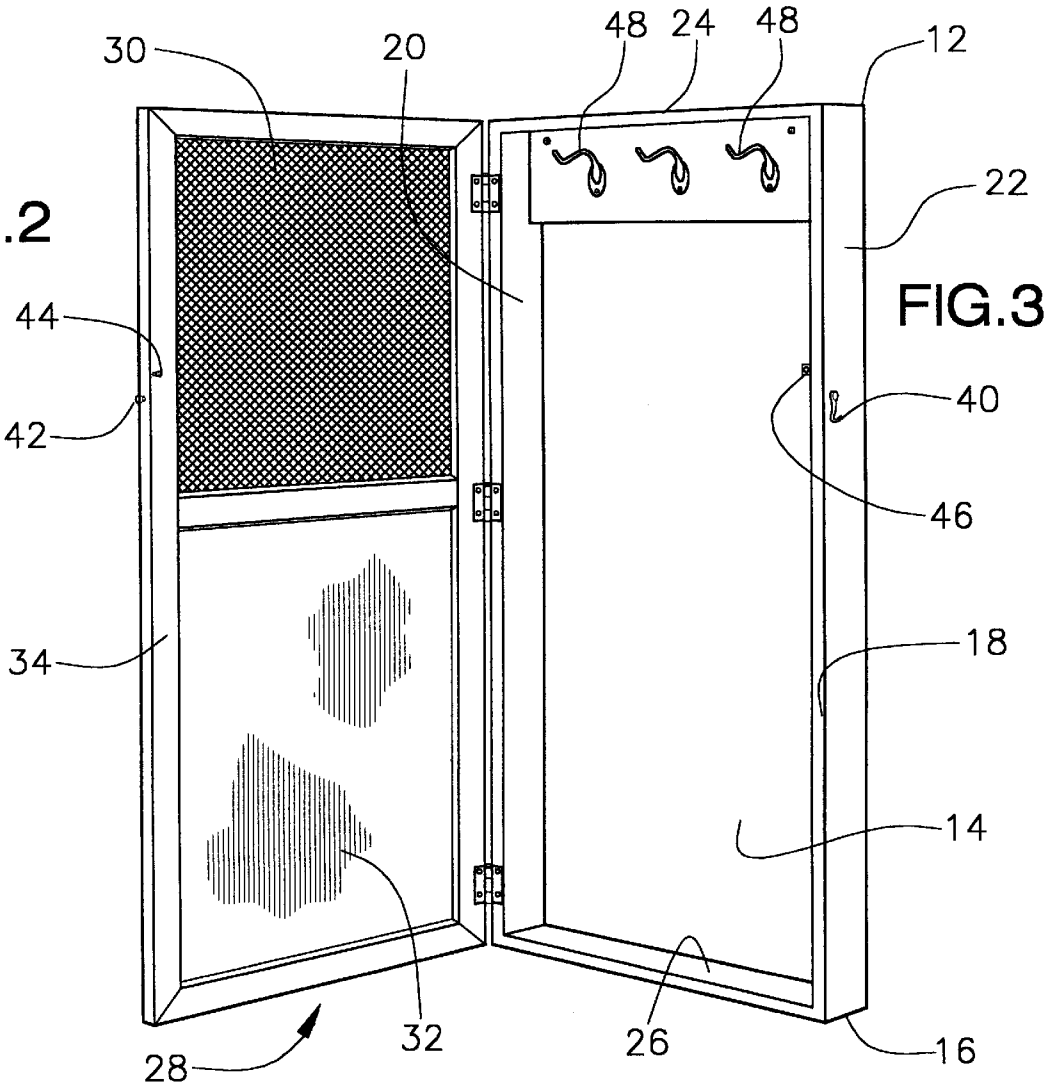
FIG. 3 is a schematic perspective view of the present invention.
Figure 2:
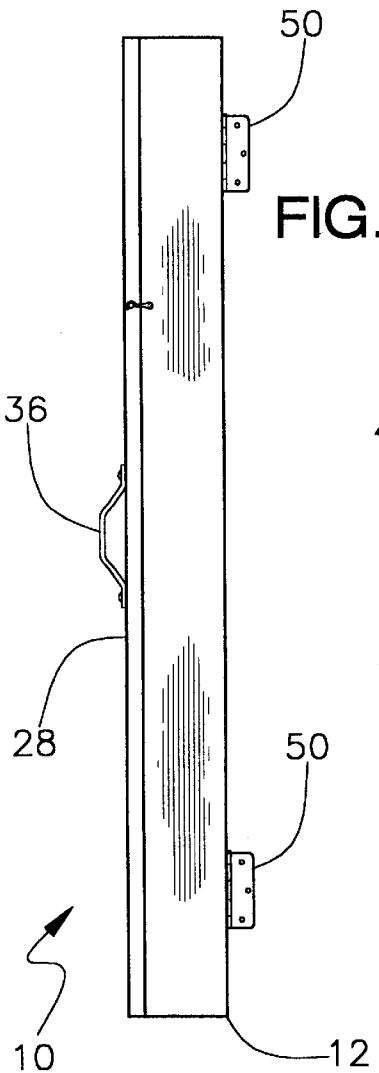
FIG. 2 is a schematic side view of the present invention.

With reference now to the drawings, and in particular to FIGS. 1 through 3 thereof, a new garment holding device embodying the principles and concepts of the present invention and generally designated by the reference numeral 10 will be described.

As best illustrated in FIGS. 1 through 3, the garment holding device 10 generally comprises a housing 12 having a back wall 14 and a peripheral wall 16 extending away from and attached to the back wall 14. The peripheral wall 16 has an outer edge 18 defining an opening into the housing 12. The back wall 14 has a generally rectangular shape such that the peripheral wall 16 includes a pair of lateral sides 20, 22 a top side 24 and a bottom side 26.

A door 28 is hingedly coupled to a first of the lateral sides 20 of the peripheral wall 16 and is selectively positioned between a closed position generally covering the opening in the housing 12 and an open position. The door 28 has a top portion 30 and bottom portion 32 bounded by a frame 34. The bottom portion 32 comprises a panel and the top portion 30 preferably comprises a mesh material. A handle 36 is preferably attached to an outer surface of the door 28.

A fastening means 38 is adapted for releasably fastening the door 28 in the closed position. The fastening means 38 includes a hook portion 40 pivotally attached to a second of the lateral sides 22 and a loop portion 42 attached to an edge of the door 28 and positioned for engaging the hook portion 40. Alternatively, the fastening means 38 may comprise a male portion 44 and a female portion 46 wherein the male portion 44 frictionally engages the female portion 46.

A plurality of hanging members 48 is ideally attached to the back wall 14 and positioned in the housing 12. The hanging members 48 are positioned generally adjacent to the top wall 24.

A pair of hinges 50 is attached to an outer surface of the back wall 14 and positioned generally adjacent to the first side wall 20.

Each of the hinges 50 is attached to a vertical wall 52 for hingedly coupling the housing 12 to the vertical wall 52. The vertical wall 52 may be the frame of a closet door, a dwelling wall or the closet door itself.

In use, the device 10 is attached to the vertical wall 52 and is used as an additional closet. It may be positioned on a closet door, either on the inside surface or the outside surface for placing easily accessible garments.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An auxiliary closet device for attaching to a vertical surface, said device comprising:

a housing having a back wall, and a peripheral wall extending away from and being attached to said back wall, said peripheral wall having an outer edge defining an opening into said housing, said back wall having a generally rectangular shape such that said peripheral wall includes a pair of lateral sides, a top side and a bottom side;

a door being hingedly coupled to a first of said lateral sides of said peripheral wall and being selectively positioned between a closed position generally covering said opening in said housing and an open position, said door having a top portion and a bottom portion bounded by a frame, said bottom portion comprising a panel, said top portion comprising mesh material;

a fastening means being adapted for releasably fastening said door in said closed position, said fastening means including a hook portion pivotally attached to a second of said lateral sides and a loop portion attached to an edge of said door and positioned for engaging said hook portion;

a handle being attached to an outer surface of said door;

a plurality of hanging members being attached to said back wall and positioned in said housing, said hanging members being positioned generally adjacent to said top wall; and a pair of hinges being attached to said back wall and being positioned generally adjacent to said first side wall, each of said hinges being attached to the vertical surface for hingedly coupling said housing to the vertical surface.

* * * * *